US011404027B2

(12) United States Patent
Zheng

(10) Patent No.: US 11,404,027 B2
(45) Date of Patent: Aug. 2, 2022

(54) IMAGE PROCESSING METHOD AND DEVICE, ELECTRONIC DEVICE, AND STORAGE MEDIUM

(71) Applicant: BEIJING XIAOMI MOBILE SOFTWARE CO., LTD., Beijing (CN)

(72) Inventor: Wenbai Zheng, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 17/146,779

(22) Filed: Jan. 12, 2021

(65) Prior Publication Data

US 2021/0375235 A1 Dec. 2, 2021

(30) Foreign Application Priority Data

May 26, 2020 (CN) ..... 202010452919.X

(51) Int. Cl.
*G09G 5/12* (2006.01)
*G09G 5/10* (2006.01)

(52) U.S. Cl.
CPC ..... *G09G 5/12* (2013.01); *G09G 5/10* (2013.01); *G09G 2320/0242* (2013.01);
(Continued)

(58) Field of Classification Search
CPC .... G09G 5/12; G09G 5/10; G09G 2320/0242; G09G 2320/04; G09G 2340/0435; G09G 2340/06
See application file for complete search history.

(56) References Cited

U.S. PATENT DOCUMENTS 7,313,764 B1 12/2007 Brunner
2012/0079401 A1* 3/2012 Huang ..... G06F 9/451 715/763

(Continued)

FOREIGN PATENT DOCUMENTS

CN 102270428 A 12/2011
CN 106445314 A 2/2017

(Continued)

OTHER PUBLICATIONS

First Office Action of the Chinese application No. 202010452919.X, dated Jul. 10, 2020, 9 pgs.

(Continued)

*Primary Examiner* — Robert J Michaud
(74) *Attorney, Agent, or Firm* — Cooper Legal Group, LLC

(57) ABSTRACT

The present disclosure relates to an image processing method and device, an electronic device, and a storage medium. The method includes: a dirty region of a display region is determined, and a percentage of the dirty region in the display region is calculated; first image data of the dirty region in an image frame to be updated for displaying and second image data of the dirty region in a presently displayed image frame are acquired, and similarity detection is performed on the first image data and the second image data to generate a similarity detection result; and whether to update the image frame to be updated for displaying to the display region is determined according to the similarity detection result and the percentage of the dirty region in the display region, and if NO, an updating request for the image frame to be updated for displaying is shielded.

14 Claims, 6 Drawing Sheets

(52) U.S. Cl.
CPC . *G09G 2320/04* (2013.01); *G09G 2340/0435* (2013.01); *G09G 2340/06* (2013.01)

(56) References Cited

U.S. PATENT DOCUMENTS

| | | | |
|---|---|---|---|
| 2014/0043358 | A1 | 2/2014 | Wang |
| 2016/0353101 | A1 | 12/2016 | Wang |
| 2017/0365236 | A1 | 12/2017 | Marchya et al. |
| 2018/0007371 | A1* | 1/2018 | Diefenbaugh ..... H04N 21/440227 |
| 2018/0108311 | A1 | 4/2018 | Wang et al. |

FOREIGN PATENT DOCUMENTS

| | | | |
|---|---|---|---|
| CN | 107316270 | A | 11/2017 |
| CN | 108549534 | A | 9/2018 |
| CN | 109005457 | A | 12/2018 |

OTHER PUBLICATIONS

European Search Report in the European application No. 21151726.3, dated Jun. 11, 2021, 14 pgs.

* cited by examiner

IMAGE PROCESSING METHOD AND DEVICE, ELECTRONIC DEVICE, AND STORAGE MEDIUM

CROSS-REFERENCE TO RELATED APPLICATION

This application is based upon and claims priority to Chinese Patent Application No. 202010452919.X, filed on May 26, 2020, the entire content of which is incorporated herein by reference.

TECHNICAL FIELD

The present disclosure relates to an image updating technology for electronic devices, and more particularly, to an image processing method and device, an electronic device, and a storage medium.

BACKGROUND

At present, for meeting a requirement of a user on a screen response, an electronic device supports a screen refresh rate of 60 Hz and even 90 Hz. For example, if the screen refresh rate is 60 Hz, an operating system such as an Android® system requires each image frame to be drawn in about 16 ms to ensure an experience in fluent image displaying of the electronic device. Although the screen refresh rate of 60 Hz and even 90 Hz has been supported at present, when a user starts multiple applications or starts a large application, the present screen refresh rate is still unlikely to meet a processing requirement of the user on an image displayed on a display screen.

SUMMARY

According to an aspect of embodiments of the present disclosure, an image processing method is provided, which may include: a dirty region of a display region is determined, and a percentage of the dirty region in the display region is calculated; first image data of the dirty region in an image frame to be updated for displaying and second image data of the dirty region in a presently displayed image frame are acquired, and similarity detection is performed on the first image data and the second image data to generate a similarity detection result; and whether to update the image frame to be updated for displaying to the display region is determined according to the similarity detection result and the percentage of the dirty region in the display region, and if NO, an updating request for the image frame to be updated for displaying is shielded.

According to an aspect of embodiments of the present disclosure, an image processing method is provided, which may include: a dirty region of a display region is determined; first image data of the dirty region in an image frame to be updated for displaying and second image data of the dirty region in a presently displayed image frame are acquired, and similarity detection is performed on the first image data and the second image data to generate a similarity detection result; and whether to update the image frame to be updated for displaying to the display region is determined according to the similarity detection result, and if NO, an updating request for the image frame to be updated for displaying is shielded.

According to an aspect of embodiments of the present disclosure, an image processing device is provided, which may include: a processor and a memory for storing instructions executable by the processor. The processor may be configured to perform any one of the above methods.

It is to be understood that the above general descriptions and detailed descriptions below are only exemplary and explanatory and not intended to limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

An image processing method in embodiments of the present disclosure is applied to an electronic device installed with an Android® operating system, particularly an electronic device such as a mobile phone, an intelligent terminal, and a gaming console, and is mainly for optimization processing for frame refreshing of the electronic device.

Figure 1:
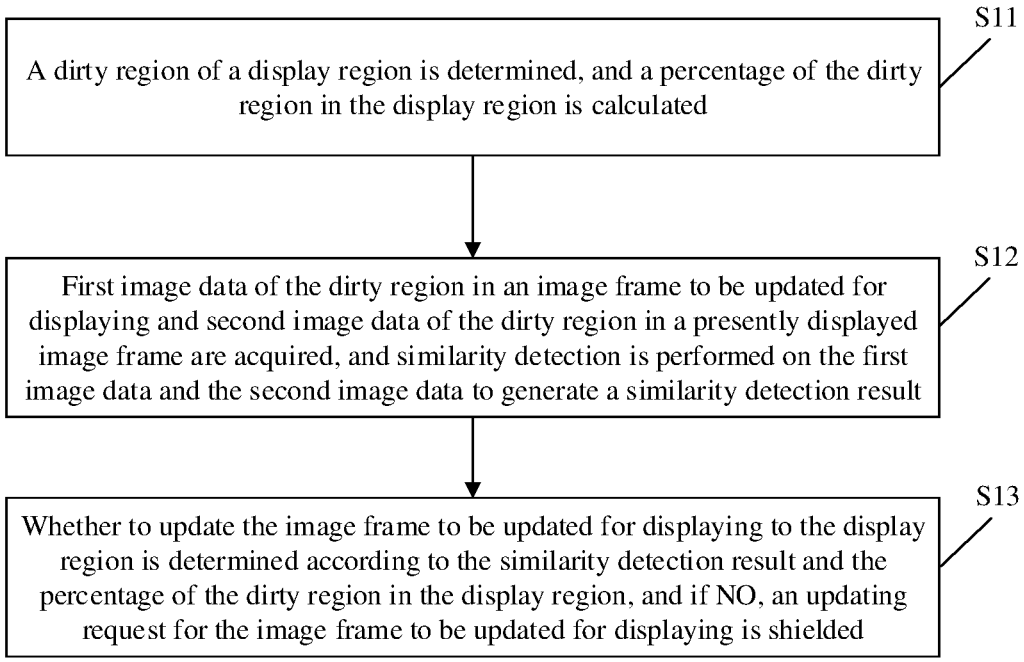
FIG. 1 is a first flow chart showing an image processing method, according to an embodiment of the present disclosure.

FIG. 1 is a first flow chart showing an image processing method, according to an embodiment of the present disclosure. As illustrated in FIG. 1, the image processing method in the embodiment of the present disclosure includes the following operations.

At S11, a dirty region of a display region is determined, and a percentage of the dirty region in the display region is calculated.

The image processing method in the embodiment of the present disclosure is applied to an electronic device. The electronic device may be a mobile phone, a gaming console, a wearable device, a virtual reality device, a personal digital assistant, a notebook computer, a tablet computer, a television terminal, or the like.

Dirty region redrawing refers to redrawing of a changed region only, rather than full-screen refreshing when a graphical interface is drawn in each frame. Therefore, in the embodiment of the present disclosure, before a response is given to image frame updating of an operating system, the dirty region of the display region is determined and the percentage of the dirty region in the display region is calculated.

At S12, first image data of the dirty region in an image frame to be updated for displaying and second image data of the dirty region in a presently displayed image frame are acquired, and similarity detection is performed on the first image data and the second image data to generate a similarity detection result.

In the embodiment of the present disclosure, after the dirty region is determined, the first image data of the dirty region in the image frame to be updated for displaying is not combined and displayed to the display region. Instead, it is necessary to compare the image data of the dirty region in the image frame to be updated for displaying with the image data of the dirty region in the presently displayed image frame and determine whether a difference therebetween exceeds a set threshold value. When the difference between the image data of the dirty regions in the image frame to be updated for displaying and the presently displayed image frame exceeds the set threshold value, the image data of the dirty region in the image frame to be updated for displaying is updated to the display region and displayed through a screen. When the difference between the image data of the dirty regions in the image frame to be updated for displaying and the presently displayed image frame does not exceed the set threshold value, an updating request for the image frame to be updated for displaying is shielded, and the image data of the dirty region in the image frame to be updated for displaying is not updated to the display region.

In the embodiment of the present disclosure, for improving the efficiency of comparison for a similarity between the image data of the dirty regions in the two image frames, before the image data is compared, the image data of the dirty regions needs to be processed.

As an implementation means, compression is performed to change resolutions of the image data of the dirty regions in the image frame to be updated for displaying and the presently displayed image frame to a set resolution. For example, the image data of each of the dirty regions may be compressed to a small image of 9×8 (numbers of columns of pixels by number of rows of pixels), thereby reducing image detail information. Of course, the image data of the dirty region may also be compressed to a small image with another resolution as required, and the resolution may specifically be set according to a practical requirement of the operating system to be, for example, 18×17, 20×17, 35×33, 48×33, and the like. If the image is reduced more, the processing speed for similarity comparison of the images is higher, and the accuracy of the similarity is correspondingly reduced to a certain extent.

As an implementation means, color red green blue (RGB) values of the image data of the dirty regions in the image frame to be updated for displaying and the presently displayed image frame with the set resolution are converted to gray values for gray image displaying. Converting the color RGB value of the reduced image to a gray represented by an integer from 0 to 255 simplifies three-dimensional comparison to one-dimensional comparison, such that the efficiency of comparison for the similarity between the image data of the dirty regions in the embodiments of the present disclosure is improved.

In the embodiments of the present disclosure, the operation in which similarity detection is performed on the first image data and the second image data to generate the similarity detection result includes operations as follows. Color intensity differences between adjacent pixels in the first image data are determined, binary values are assigned to the color intensity differences, the assigned binary values of continuous color intensity differences form a first binary character string, and a first hash value of the first binary character string is determined. Color intensity differences between adjacent pixels in the second image data are determined, binary values are assigned to the color intensity differences, the assigned binary values of continuous color intensity differences form a second binary character string, and a second hash value of the second binary character string is determined. A Hamming distance between the first hash value and the second hash value is calculated, and the calculated Hamming distance between the first hash value and the second hash value is a Hamming distance between the images of the dirty regions in the image frame to be updated for displaying and the presently displayed image frame. The calculated Hamming distance is determined as a similarity value of the first image data and the second image data to obtain the similarity detection result.

In the embodiments of the present disclosure, similarity detection may be performed on the first image data and the second image data by use of a perceptual Hash (pHash) algorithm. The pHash is a general term of a type of algorithms, including average Hash (aHash), pHash, difference Hash (dHash), and the like. pHash calculates a hash value in a more relative manner rather than calculating the specific hash value in a strict manner, and this is because being similar or not is a relative judgment. A principle thereof is to generate a fingerprint character string for each image, i.e., a set of binary digits obtained by operating the image according to a certain hash algorithm, and then compare Hamming distances between different image fingerprints. The closer the results, the more similarity that exists between the images. The Hamming distance is as follows: if a first set of binary data is 101 and a second set is 111, the second digit 0 of the first set may be changed to 1 so as to obtain the second set of data 111, and in such case, a Hamming distance between the two sets of data is 1. In short, the Hamming distance is the number of steps required to change a set of binary data to another set of data. It is apparent that a difference between two images may be measured through the numerical value. The smaller the Hamming distance, the more similarity that exists. If the Hamming distance is 0, the two images are completely the same.

The aHash algorithm is relatively high in calculation speed but relatively poor in accuracy. The pHash algorithm is relatively high in calculation accuracy but relatively low in operation speed. The dHash algorithm is relatively high in accuracy and also high in speed. Therefore, in the embodiments of the present disclosure, the dHash algorithm is preferred to perform similarity detection on the first image data and the second image data to determine the similarity value of the dirty regions in the two image frames.

The operation in which the first hash value of the first binary character string is determined includes: high-base conversion being performed on the first binary character string to form converted first high-base characters, and the first high-base characters being sequenced to form a character string to form a first difference hash value; and high-base conversion being performed on the second binary character string to form converted second high-base characters, and the second high-base characters being sequenced to form a character string to form a second difference hash value.

The dHash algorithm is implemented based on a morphing algorithm, and is specifically implemented as follows: (1) the image is compressed to a 9×8 small image with 72 pixels; (2) the image is converted to a gray image; (3) the differences are calculated: the differences between the adjacent pixels of the image frame are determined at first through the dHash algorithm; if the left pixel is brighter than the right one, 1 is recorded; otherwise, 0 is recorded; in such a manner, eight different differences are generated between nine pixels in each row, and there are a total of eight rows, so 64 differences or a 32-bit 01 character string is generated; and (4) the Hamming distance between the image frames is calculated through the hash values based on the difference between character strings, and the Hamming distance is determined as the similarity value between the two image frames.

In the embodiments of the present disclosure, the similarity between the two image frames may also be calculated in a histogram manner. In the histogram manner, the image similarity is measured based on a simple vector similarity, and is usually measured by use of a color feature, and this manner is suitable for describing an image difficult to automatically segment. However, a probability distribution of image gray values is mainly reflected, no spatial position information of the image is provided, and a large amount of information is lost, such that the misjudgment rate is high. However, as an implementation means, the similarity between the two image frames may also be calculated in the histogram manner.

At S13, whether to update the image frame to be updated for displaying to the display region is determined according to the similarity detection result and the percentage of the dirty region in the display region, and if NO, an updating request for the image frame to be updated for displaying is shielded.

In the embodiments of the present disclosure, a first weight value is set for the percentage of the dirty region in the display region, and a second weight value is set for the similarity value.

A first product value of the first weight value and the percentage of the dirty region in the display region is calculated, and a second product value of the second weight value and the similarity value is calculated. A sum value of the first product value and the second product value is calculated. The sum value is compared with a set threshold value. When the sum value is greater than or equal to the set threshold value, it is determined that the image frame to be updated for displaying is updated to the display region. Correspondingly, when the sum value is less than the set threshold value, it is determined that the image frame to be updated for displaying is not updated to the display region.

In the embodiments of the present disclosure, the operation in which the updating request for the image frame to be updated for displaying is shielded includes: when a dynamic adjustment vertical sync (Vsync) signal of the display region is received, the Vsync signal is intercepted, such that a SurfaceFlinger does not compose a content of the image frame to be updated for displaying. For example, for a Vsync signal of an Android® system, the Vsync signal in the Android® system may be divided into two types: one is a hardware Vsync signal generated by the screen, and the other is a software Vsync signal generated by the SurfaceFlinger. The first type of Vsync signal (the hardware Vsync signal) is essentially a pulse signal, which is generated by a hardware composer (HWC) module according to a screen refresh rate and is configured to trigger or switch some operations. The second type of Vsync signal (the software Vsync signal) is transmitted to a Choreographer through a Binder. Therefore, a Vsync signal may be sent to notify the operating system to prepare for refreshing before every refresh of the screen of the electronic device, and then the system calls a central processing unit (CPU) and a graphics processing unit (GPU) for user interface (UI) updating.

According to the embodiments of the present disclosure, when it is determined that the similarity between the dirty regions in the previous and next image frames is less than the set threshold value, a Vsync effect on the display region is achieved by intercepting the image frame updating request, i.e., the Vsync signal, for the system, so as to reduce influence brought to the power consumption by drawing of the GPU and the CPU, such that the power consumption of the electronic device for refreshing of the display region is reduced to a certain extent, and the overall performance and battery life of the electronic device are improved.

Figure 2:
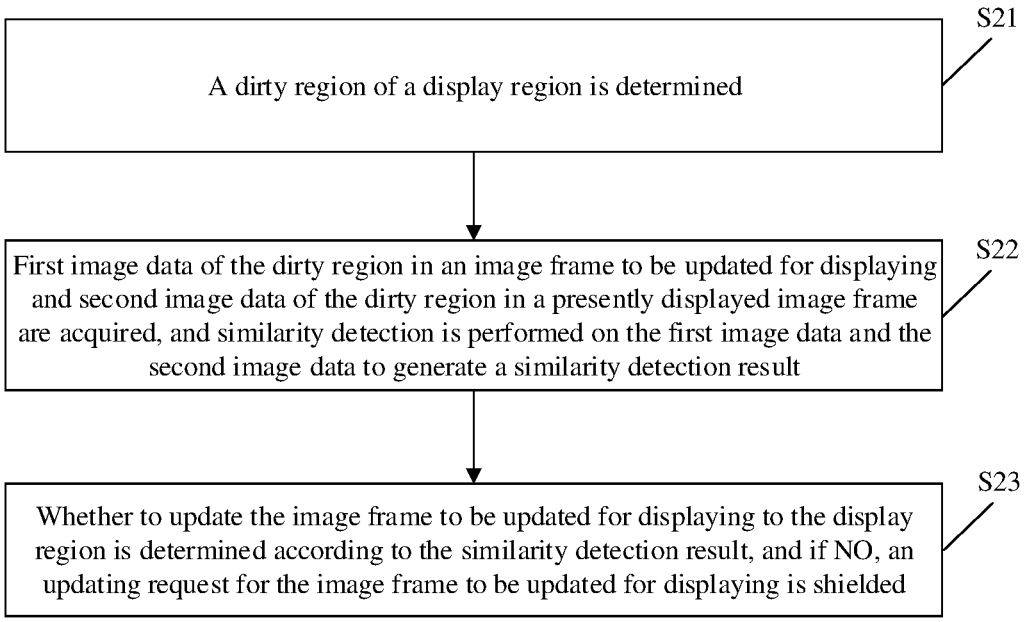
FIG. 2 is a second flow chart showing an image processing method, according to an embodiment of the present disclosure.

FIG. 2 is a second flow chart showing an image processing method, according to an embodiment of the present disclosure. As illustrated in FIG. 2, the image processing method in the embodiment of the present disclosure includes the following operations.

At S21, a dirty region of a display region is determined.

The image processing method in the embodiment of the present disclosure is applied to an electronic device. The electronic device may be a mobile phone, a gaming console, a wearable device, a virtual reality device, a personal digital assistant, a notebook computer, a tablet computer, a television terminal, or the like.

Dirty region redrawing refers to redrawing of a changed region only, rather than full-screen refreshing when a graphical interface is drawn in each frame. Therefore, in the embodiment of the present disclosure, before a response is given to image frame updating of an operating system, the dirty region of the display region is determined.

At S22, first image data of the dirty region in an image frame to be updated for displaying and second image data of the dirty region in a presently displayed image frame are acquired, and similarity detection is performed on the first image data and the second image data to generate a similarity detection result.

In the embodiment of the present disclosure, after the dirty region is determined, the first image data of the dirty region in the image frame to be updated for displaying is not combined and displayed to the display region. Instead, it is necessary to compare the image data of the dirty region in the image frame to be updated for displaying with the image data of the dirty region in the presently displayed image frame and determine whether a difference therebetween exceeds a set threshold value. When the difference between the image data of the dirty regions in the image frame to be updated for displaying and the presently displayed image frame exceeds the set threshold value, the image data of the dirty region in the image frame to be updated for displaying is updated to the display region and displayed through a screen. When the difference between the image data of the dirty regions in the image frame to be updated for displaying and the presently displayed image frame does not exceed the set threshold value, an updating request for the image frame to be updated for displaying is shielded, and the image data of the dirty region in the image frame to be updated for displaying is not updated to the display region.

In the embodiment of the present disclosure, for improving the efficiency of comparison for a similarity between the image data of the dirty regions in the two image frames, before the image data is compared, the image data of the dirty regions needs to be processed.

As an implementation means, compression is performed to change resolutions of the image data of the dirty regions in the image frame to be updated for displaying and the presently displayed image frame to a set resolution. For example, the image data of each of the dirty regions may be compressed to a small image of 9×8, thereby reducing image detail information. Of course, the image data of the dirty region may also be compressed to a small image with another resolution as required, and the resolution may specifically be set according to a practical requirement of the operating system to be, for example, 18×17, 20×17, 35×33, 48×33, and the like. If the image is reduced more, the processing speed for similarity comparison of the images is higher, and the accuracy of the similarity is correspondingly reduced to a certain extent.

As an implementation means, color RGB values of the image data of the dirty regions in the image frame to be updated for displaying and the presently displayed image frame with the set resolution are converted to gray values for gray image displaying. Converting the color RGB value of the reduced image to a gray represented by an integer from 0 to 255 simplifies three-dimensional comparison to one-dimensional comparison, such that the efficiency of comparison for the similarity between the image data of the dirty regions in the embodiments of the present disclosure is improved.

In the embodiments of the present disclosure, the operation in which similarity detection is performed on the first image data and the second image data to generate the similarity detection result includes operations as follows. Color intensity differences between adjacent pixels in the first image data are determined, binary values are assigned to the color intensity differences, the assigned binary values of continuous color intensity differences form a first binary character string, and a first hash value of the first binary character string is determined. Color intensity differences between adjacent pixels in the second image data are determined, binary values are assigned to the color intensity differences, the assigned binary values of continuous color intensity differences form a second binary character string, and a second hash value of the second binary character string is determined. A Hamming distance between the first hash value and the second hash value is calculated, and the calculated Hamming distance between the first hash value and the second hash value is a Hamming distance between the images of the dirty regions in the image frame to be updated for displaying and the presently displayed image frame. The calculated Hamming distance is determined as a similarity value of the first image data and the second image data to obtain the similarity detection result.

In the embodiments of the present disclosure, similarity detection may be performed on the first image data and the second image data by use of a pHash algorithm. The pHash is a general term of a type of algorithms, including average Hash (aHash), pHash, difference Hash (dHash), and the like. pHash calculates a hash value in a more relative manner rather than calculating the specific hash value in a strict manner, and this is because being similar or not is a relative judgment. A principle thereof is to generate a fingerprint character string for each image, i.e., a set of binary digits obtained by operating the image according to a certain hash algorithm, and then compare Hamming distances between different image fingerprints. The closer the results, the more similarity that exists between the images. The Hamming distance is as follows: if a first set of binary data is 101 and a second set is 111, the second digit 0 of the first set may be changed to 1 so as to obtain the second set of data 111, and in such case, a Hamming distance between the two sets of data is 1. In short, the Hamming distance is the number of steps required to change a set of binary data to another set of data. It is apparent that a difference between two images may be measured through the numerical value. The smaller the Hamming distance, the more similarity that exists. If the Hamming distance is 0, the two images are completely the same.

The aHash algorithm is relatively high in calculation speed but relatively poor in accuracy. The pHash algorithm is relatively high in calculation accuracy but relatively low in operation speed. The dHash algorithm is relatively high in accuracy and also high in speed. Therefore, in the embodiments of the present disclosure, the dHash algorithm is preferred to perform similarity detection on the first image data and the second image data to determine the similarity value of the dirty regions in the two image frames.

The operation in which the first hash value of the first binary character string is determined includes: high-base conversion being performed on the first binary character string to form converted first high-base characters, and the first high-base characters being sequenced to form a character string to form a first difference hash value; and high-base conversion being performed on the second binary character string to form converted second high-base characters, and the second high-base characters being sequenced to form a character string to form a second difference hash value.

The dHash algorithm is implemented based on a morphing algorithm, and is specifically implemented as follows: (1) the image is compressed to a 9×8 small image with 72 pixels; (2) the image is converted to a gray image; (3) the differences are calculated: the differences between the adjacent pixels of the image frame are determined at first through the dHash algorithm; if the left pixel is brighter than the right one, 1 is recorded; otherwise, 0 is recorded; in such a manner, eight different differences are generated between nine pixels in each row, and there are a total of eight rows, so 64 differences or a 32-bit 01 character string is generated; and (4) the Hamming distance between the image frames is calculated through the hash values based on the difference between character strings, and the Hamming distance is determined as the similarity value between the two image frames.

In the embodiments of the present disclosure, the similarity between the two image frames may also be calculated in a histogram manner. In the histogram manner, the image similarity is measured based on a simple vector similarity, and is usually measured by use of a color feature, and this manner is suitable for describing an image difficult to automatically segment. However, a probability distribution of image gray values is mainly reflected, no spatial position information of the image is provided, and a large amount of information is lost, such that the misjudgment rate is high. However, as an implementation means, the similarity between the two image frames may also be calculated in the histogram manner.

At S23, whether to update the image frame to be updated for displaying to the display region is determined according to the similarity detection result, and if NO, an updating request for the image frame to be updated for displaying is shielded.

In the embodiments of the present disclosure, the similarity value is compared with a set threshold value; when the similarity value is greater than or equal to the set threshold value, it is determined that the image frame to be updated for displaying is updated to the display region. Correspondingly, when the similarity value is less than the set threshold value, it is determined that the image frame to be updated for displaying is not updated to the display region.

In the embodiments of the present disclosure, the operation in which the updating request for the image frame to be updated for displaying is shielded includes: when a dynamic adjustment Vsync signal of the display region is received, the Vsync signal is intercepted, such that a SurfaceFlinger does not compose a content of the image frame to be updated for displaying. For example, for a Vsync signal of an Android® system, the Vsync signal in the Android® system may be divided into two types: one is a hardware Vsync signal generated by the screen, and the other is a software Vsync signal generated by the SurfaceFlinger. The first type of Vsync signal (the hardware Vsync signal) is essentially a pulse signal, which is generated by an HWC module according to a screen refresh rate and is configured to trigger or switch some operations. The second type of Vsync signal (the software Vsync signal) is transmitted to a Choreographer through a Binder. Therefore, a Vsync signal may be sent to notify the operating system to prepare for refreshing before every refresh of the screen of the electronic device, and then the system calls a CPU and a GPU for UI updating.

According to the embodiments of the present disclosure, when it is determined that the similarity between the dirty regions in the previous and next image frames is less than the set threshold value, a Vsync effect on the display region is achieved by intercepting the image frame updating request, i.e., the Vsync signal, for the system, so as to reduce influence brought to the power consumption by drawing of the GPU and the CPU, such that the power consumption of the electronic device for refreshing of the display region is reduced to a certain extent, and the overall performance and battery life of the electronic device are improved.

The essence of the technical solution of the embodiments of the present disclosure will further be elaborated below in combination with a specific example.

In an Android® system, during a process of displaying an image on a screen, it is necessary to redraw different display regions, and a specific redrawn and refreshed part is called a dirty region, i.e., a dirty visible region, namely a region to be refreshed. In the embodiments of the present disclosure, the dirty region to be refreshed in the display process is utilized, and a percentage of the dirty region in the whole display region is calculated. Meanwhile, similarity detection is performed on the dirty region by use of the dHash algorithm, and a new detection model for a similarity between two frames is constructed based on the two values (i.e., the percentage value and the similarity value). Compared with performing similarity detection on the whole display region, this manner has the advantage that the processing speed is increased. Or, difference hash values of the dirty regions in two image frames are directly utilized, a similarity value between image data of the dirty regions in the two image frames is determined, and whether to perform composition processing on next frame layer data through a SurfaceFlinger is determined based on the similarity value.

The dirty region to be refreshed in the display process is utilized, and the percentage p of the dirty region in the whole display region is calculated. Meanwhile, similarity detection is performed on the dirty region by use of the dHash algorithm to obtain the similarity s, and the new detection model for the similarity between the two frames is constructed based on the two values (i.e., the percentage value and the similarity value). The similarity value obtained based on the detection model may be applied to a layer composition strategy of the SurfaceFlinger to control transmission of the Vsync signal, thereby achieving a purpose of dynamic Vsync, which is to reduce the influence brought to the performance by redrawing of the GPU and the CPU.

Figure 3:
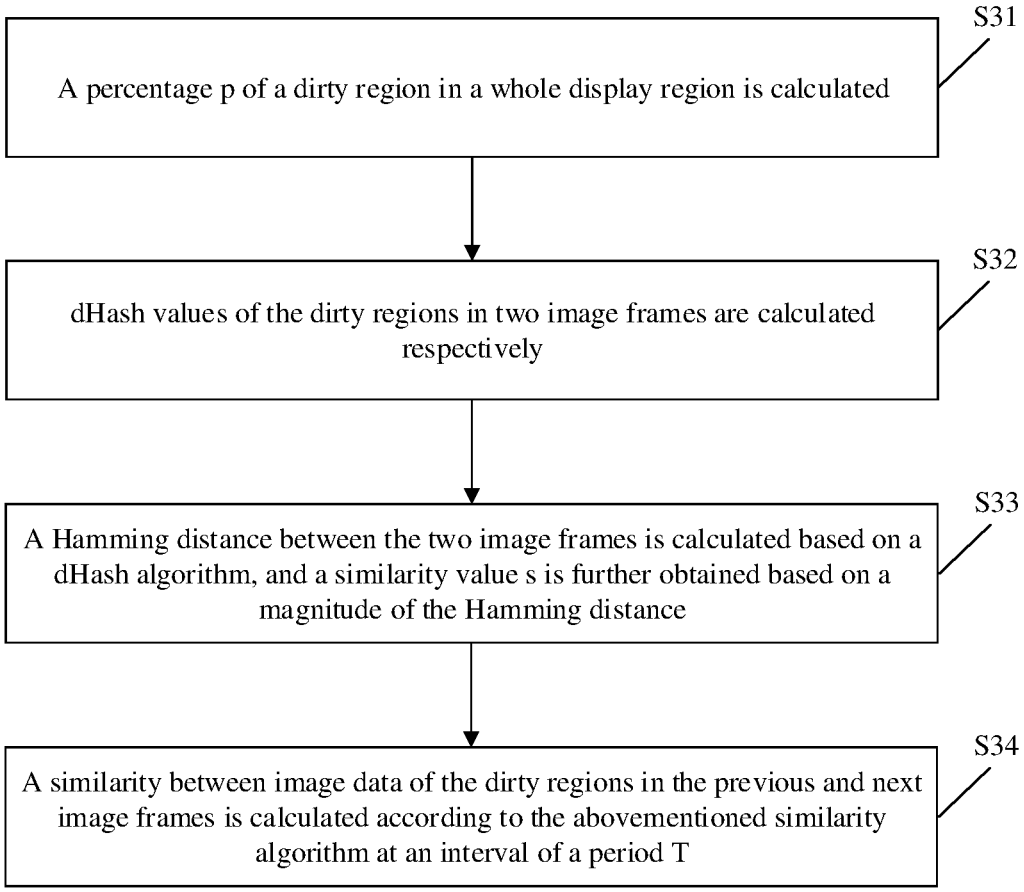
FIG. 3 is a third flow chart showing an image processing method, according to an embodiment of the present disclosure.

FIG. 3 is a third flow chart showing an image processing method, according to an embodiment of the present disclosure. As illustrated in FIG. 3, the image processing method in the embodiment of the present disclosure mainly includes the following processing operations.

At S31, a dirty region of a display region of an electronic device is acquired, and a percentage p of the dirty region in the whole display region is calculated.

At S32, dHash values of the dirty regions in two image frames are calculated respectively.

1) Images are reduced at first: the dirty regions are compressed to 9×8 small images. The images are compressed to reduce image detail information.

2) Gray processing is performed: color RGB values of the reduced images are converted to grays represented by integers from 0 to 255 to simplify three-dimensional comparison to one-dimensional comparison.

3) Differences are calculated: color intensity differences between adjacent pixels in each image subjected to gray processing are calculated. In each image, the differences between the adjacent pixels are calculated by taking each row as a unit. Since there are nine pixels in each row of the reduced image, eight differences may be generated, and the image may be converted to be hexadecimal. If a color intensity of a first pixel is greater than a color intensity of a second pixel, a difference is set to be True (i.e., 1), and if it is not greater than the second pixel, the difference is set to be False (i.e., 0).

4) Conversion to hash values is performed: each value in a difference array is considered as a bit, every eight bits form a hexadecimal value, and thus eight hexadecimal values are obtained. The hexadecimal values are connected and converted to a character string to obtain the final dHash value.

At S33, a Hamming distance between the two image frames is calculated based on a dHash algorithm, and a similarity value s is further obtained based on a magnitude of the Hamming distance. Herein, the two image frames refer to an image frame to be updated for displaying and a presently displayed image frame respectively.

1) The two dHash values are converted to binary differences, an exclusive or (xor) operation is executed, and the bit number of xor results "1", i.e., the number of bits representing differences, is calculated to obtain the Hamming distance.

2) The similarity s is obtained by comparison according to the Hamming distance of the dirty regions in the two frames.

3) A calculation formula of a model for a similarity between two frames is established according to the calculated percentage p of the dirty region and the similarity s, i.e.:

$$\text{Similarity}(p,s)=\alpha*p+\beta*s \quad (1).$$

In the formula (1), p represents the percentage of the dirty region in the whole display region, s represents the similarity between the dirty regions in the previous and next frames, a is a weight parameter of p, β is a weight parameter of s, and $\alpha+\beta=1$. Values of a and β may be regulated as required.

At S34, a similarity Similarity(p, s) between image data of the dirty regions in the previous and next image frames is calculated according to the similarity algorithm introduced above at an interval of a period T. A similarity threshold value £ is set, and magnitudes of the similarity Similarity(p, s) and the threshold value £ are compared. When Similarity (p, s) is less than or equal to £, the similarity between the previous and next image frames is relatively low, namely the previous and next image frames are greatly different, such that a Vsync signal is not processed and is normally distributed and transmitted to a SurfaceFlinger for normal layer composition and updating. When Similarity(p, s) is more than £, the similarity between the previous and next image frames is relatively high, and in such case, the system intercepts the Vsync signal for updating to trigger a mechanism disabling the SurfaceFlinger to update the next frame, thereby achieving the purpose of reducing the power consumption during running of a GPU and a CPU to reduce the influence brought to the power consumption by UI redrawing during running of the electronic device and further improve the overall performance of the electronic device.

Figure 4:
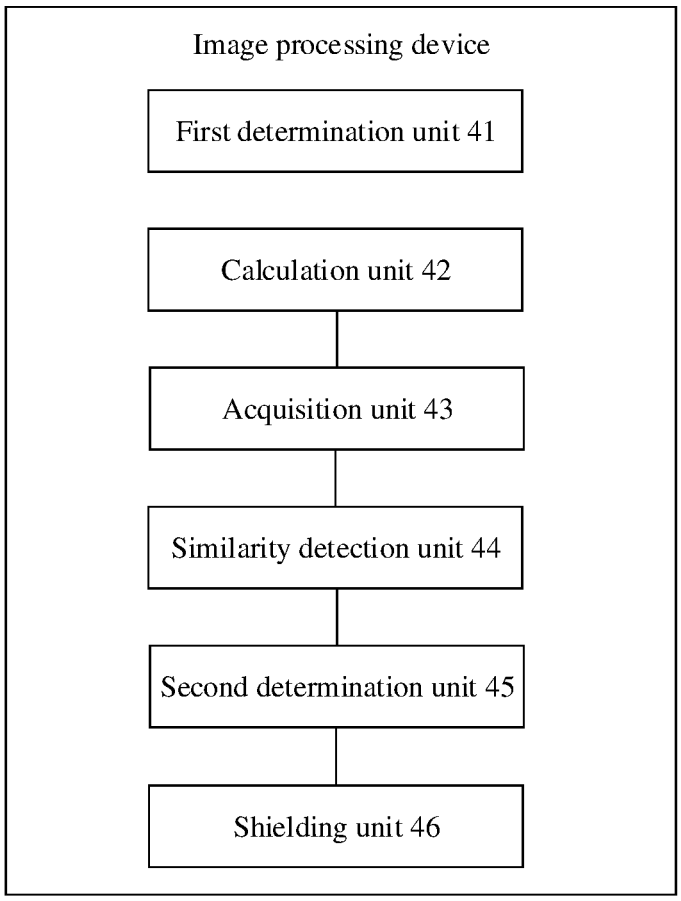
FIG. 4 is a composition structure diagram of a first image processing device, according to an embodiment of the present disclosure.

FIG. 4 is a composition structure diagram of a first image processing device, according to an embodiment of the present disclosure. As illustrated in FIG. 4, the first image processing device in the embodiment of the present disclosure includes: a first determination unit 41, a calculation unit 42, an acquisition unit 43, a similarity detection unit 44, a second determination unit 45, and a shielding unit 46.

The first determination unit 41 is configured to determine a dirty region of a display region.

The calculation unit 42 is configured to calculate a percentage of the dirty region in the display region.

The acquisition unit 43 is configured to acquire first image data of the dirty region in an image frame to be updated for displaying and second image data of the dirty region in a presently displayed image frame.

The similarity detection unit 44 is configured to perform similarity detection on the first image data and the second image data to generate a similarity detection result.

The second determination unit 45 is configured to determine whether to update the image frame to be updated for displaying to the display region according to the similarity detection result and the percentage of the dirty region in the display region and, if NO, trigger a shielding unit.

The shielding unit 46 is configured to shield an updating request for the image frame to be updated for displaying.

Optionally, the similarity detection unit 44 includes: a first determination subunit, an assignment subunit, a second determination subunit, a first calculation subunit, and a similarity detection subunit.

The first determination subunit (not illustrated in FIG. 4) is configured to determine color intensity differences between adjacent pixels in the first image data and color intensity differences between adjacent pixels in the second image data.

The assignment subunit (not illustrated in FIG. 4) is configured to assign binary values to the color intensity differences of the first image data, the assigned binary values of continuous color intensity differences forming a first binary character string, and assign binary values to the color intensity differences of the second image data, the assigned binary values of continuous color intensity differences forming a second binary character string.

The second determination subunit (not illustrated in FIG. 4) is configured to determine a first hash value of the first binary character string and a second hash value of the second binary character string.

The first calculation subunit (not illustrated in FIG. 4) is configured to calculate a Hamming distance between the first hash value and the second hash value, the calculated Hamming distance between the first hash value and the second hash value being a Hamming distance between images of the dirty regions in the image frame to be updated for displaying and the presently displayed image frame.

The similarity detection subunit (not illustrated in FIG. 4) is configured to determine the calculated Hamming distance as a similarity value of the first image data and the second image data to obtain the similarity detection result.

Optionally, the second determination subunit is further configured to: perform high-base conversion on the first binary character string to form converted first high-base characters and sequence the first high-base characters to form a character string to form a first difference hash value; and perform high-base conversion on the second binary character string to form converted second high-base characters and sequence the second high-base characters to form a character string to form a second difference hash value.

Optionally, the first image processing device further includes: a compression unit and a conversion unit.

The compression unit (not illustrated in FIG. 4) is configured to perform compression to change resolutions of the first image data and the second image data to a set resolution.

The conversion unit (not illustrated in FIG. 4) is configured to convert color RGB values of the first image data and the second image data with the set resolution to gray values for gray image displaying.

Optionally, the first image processing device further includes: a setting unit (not illustrated in FIG. 4), configured to set a first weight value for the percentage of the dirty region in the display region, and set a second weight value for the similarity value.

The second determination unit 45 includes: a second calculation subunit, a third calculation subunit, a comparison subunit, and a third determination subunit.

The second calculation subunit (not illustrated in FIG. 4) is configured to calculate a first product value of the first weight value and the percentage of the dirty region in the display region, and calculate a second product value of the second weight value and the similarity value.

The third calculation subunit (not illustrated in FIG. 4) is configured to calculate a sum value of the first product value and the second product value.

The comparison subunit (not illustrated in FIG. 4) is configured to compare the sum value with a set threshold value.

The third determination subunit (not illustrated in FIG. 4) is configured to, when the sum value is greater than or equal to the set threshold value, determine to update the image frame to be updated for displaying to the display region, and correspondingly, when the sum value is less than the set threshold value, determine not to update the image frame to be updated for displaying to the display region.

Optionally, the shielding unit 46 includes: a receiving subunit and an interception subunit.

The receiving subunit (not illustrated in FIG. 4) is configured to receive a dynamic adjustment Vsync signal of the display region.

The interception subunit (not illustrated in FIG. 4) is configured to intercept the Vsync signal to cause a SurfaceFlinger not to compose a content of the image frame to be updated for displaying.

Figure 5:
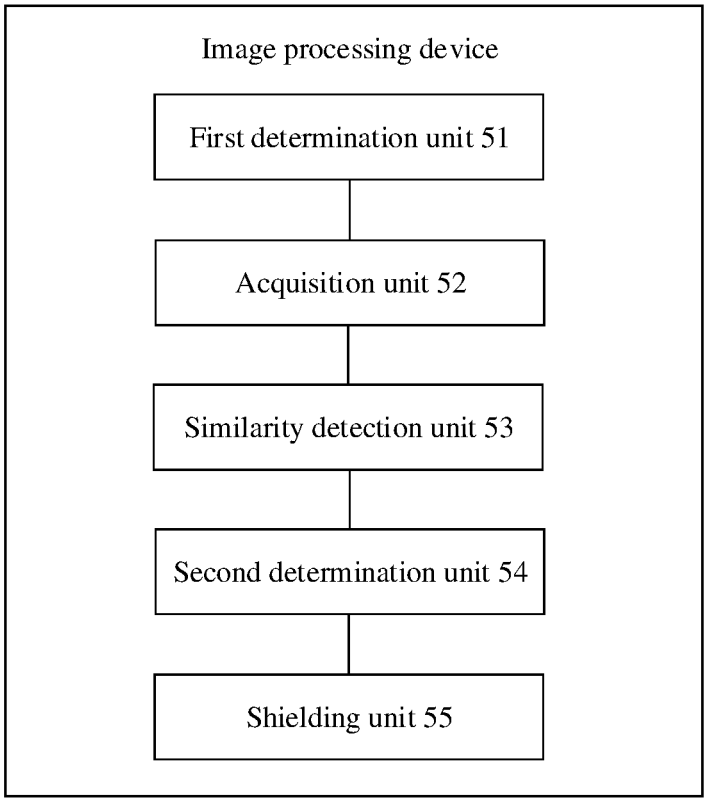
FIG. 5 is a composition structure diagram of a second image processing device, according to an embodiment of the present disclosure.

FIG. 5 is a composition structure diagram of a second image processing device, according to an embodiment of the present disclosure. As illustrated in FIG. 5, the second image processing device in the embodiment of the present disclosure includes: a first determination unit 51, an acquisition unit 52, a similarity detection unit 53, a second determination unit 54, and a shielding unit 55.

The first determination unit 51 is configured to determine a dirty region of a display region.

The acquisition unit 52 is configured to acquire first image data of the dirty region in an image frame to be updated for displaying and second image data of the dirty region in a presently displayed image frame.

The similarity detection unit 53 is configured to perform similarity detection on the first image data and the second image data to generate a similarity detection result.

The second determination unit 54 is configured to determine whether to update the image frame to be updated for displaying to the display region according to the similarity detection result and, if NO, trigger a shielding unit.

The shielding unit 55 is configured to shield an updating request for the image frame to be updated for displaying.

Optionally, the similarity detection unit 53 includes: a first determination subunit, an assignment subunit, a second determination subunit, a first calculation subunit, and a similarity detection subunit.

The first determination subunit (not illustrated in FIG. 5) is configured to determine color intensity differences between adjacent pixels in the first image data and color intensity differences between adjacent pixels in the second image data.

The assignment subunit (not illustrated in FIG. 5) is configured to assign binary values to the color intensity differences of the first image data, the assigned binary values of continuous color intensity differences forming a first binary character string, and assign binary values to the color intensity differences of the second image data, the assigned binary values of continuous color intensity differences forming a second binary character string.

The second determination subunit (not illustrated in FIG. 5) is configured to determine a first hash value of the first binary character string and a second hash value of the second binary character string.

The first calculation subunit (not illustrated in FIG. 5) is configured to calculate a Hamming distance between the first hash value and the second hash value, the calculated Hamming distance between the first hash value and the second hash value being a Hamming distance between images of the dirty regions in the image frame to be updated for displaying and the presently displayed image frame.

The similarity detection subunit (not illustrated in FIG. 5) is configured to determine the calculated Hamming distance as a similarity value of the first image data and the second image data to obtain the similarity detection result.

Optionally, the second determination subunit is further configured to: perform high-base conversion on the first binary character string to form converted first high-base characters and sequence the first high-base characters to form a character string to form a first difference hash value; and perform high-base conversion on the second binary character string to form converted second high-base characters and sequence the second high-base characters to form a character string to form a second difference hash value.

Optionally, the second image processing device further includes: a compression unit and a conversion unit.

The compression unit (not illustrated in FIG. 5) is configured to perform compression to change resolutions of the first image data and the second image data to a set resolution.

The conversion unit (not illustrated in FIG. 5) is configured to convert color RGB values of the first image data and the second image data with the set resolution to gray values for gray image displaying.

Optionally, the second determination unit 54 includes: a comparison subunit and a third determination subunit.

The comparison subunit (not illustrated in FIG. 5) is configured to compare the similarity value with a set threshold value.

The third determination subunit (not illustrated in FIG. 5) is configured to, when the similarity value is greater than or equal to the set threshold value, determine to update the image frame to be updated for displaying to the display region, and correspondingly, when the similarity value is less than the set threshold value, determine not to update the image frame to be updated for displaying to the display region.

Optionally, the shielding unit 55 includes: a receiving subunit and an interception subunit.

The receiving subunit (not illustrated in FIG. 5) is configured to receive a dynamic adjustment Vsync signal of the display region.

The interception subunit (not illustrated in FIG. 5) is configured to intercept the Vsync signal to cause a SurfaceFlinger not to compose a content of the image frame to be updated for displaying.

With respect to the device in the above embodiments, the specific manners for performing operations for individual modules therein have been described in detail in the embodiments regarding the method, which will not be repeated herein.

Figure 6:
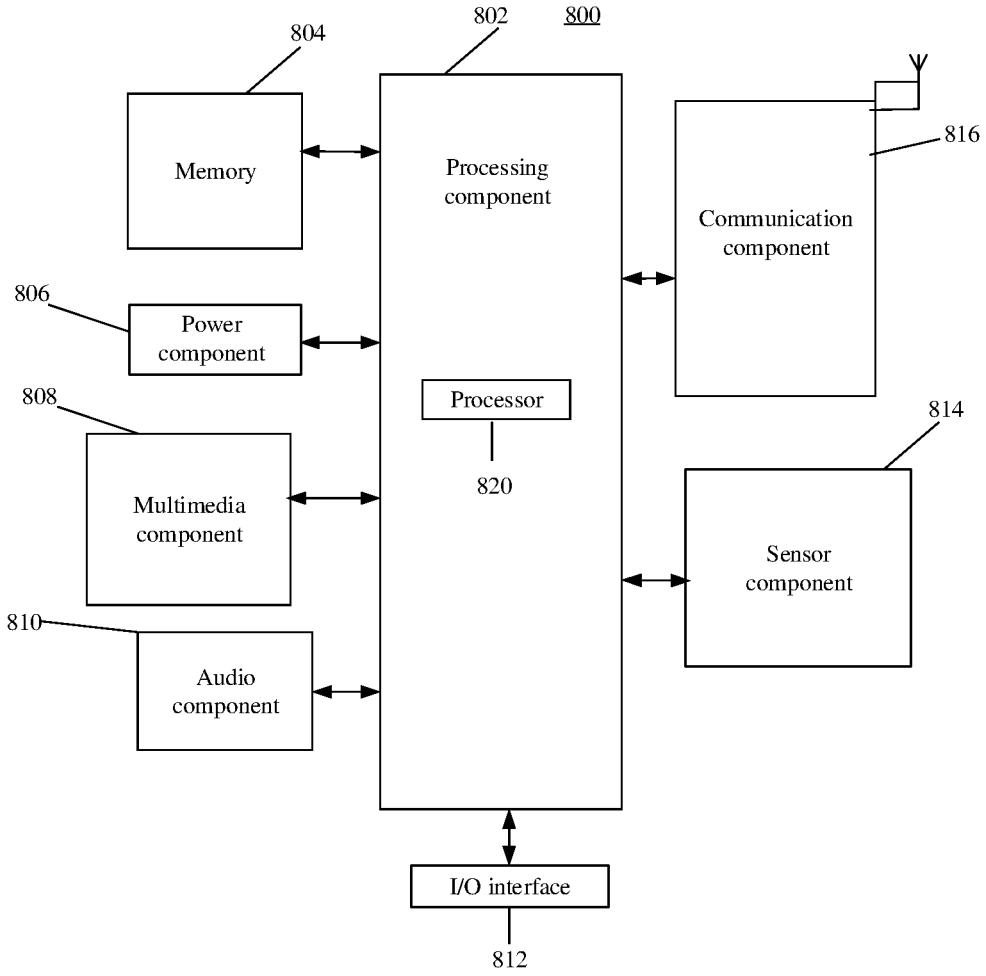
FIG. 6 is a block diagram of an electronic device, according to an embodiment of the present disclosure.

FIG. 6 is a block diagram of an electronic device 800, according to an embodiment of the present disclosure. As illustrated in FIG. 6, the electronic device 800 supports multi-screen output. The electronic device 800 may include one or more of the following components: a processing component 802, a memory 804, a power component 806, a multimedia component 808, an audio component 810, an input/output (I/O) interface 812, a sensor component 814, or a communication component 816.

The processing component 802 typically controls overall operations of the electronic device 800, such as the operations associated with display, telephone calls, data communications, camera operations, and recording operations. The processing component 802 may include one or more processors 820 to execute instructions to perform all or part of the acts in the abovementioned method. Moreover, the processing component 802 may include one or more modules which facilitate interaction between the processing component 802 and other components. For instance, the processing component 802 may include a multimedia module to facilitate interaction between the multimedia component 808 and the processing component 802.

The memory 804 is configured to store various types of data to support the operation of the electronic device 800. Examples of such data include instructions for any applications or methods operated on the electronic device 800, contact data, phonebook data, messages, pictures, video, etc. The memory 804 may be implemented by any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, and a magnetic or optical disk.

The power component 806 provides power for various components of the electronic device 800. The power component 806 may include a power management system, one or more power supplies, and other components associated with generation, management, and distribution of power for the electronic device 800.

The multimedia component 808 includes a screen providing an output interface between the electronic device 800 and a user. In some embodiments, the screen may include a liquid crystal display (LCD) and a touch panel (TP). If the screen includes the TP, the screen may be implemented as a touch screen to receive an input signal from the user. The TP includes one or more touch sensors to sense touches, swipes, and gestures on the TP. The touch sensors may not only sense a boundary of a touch or swipe action, but also detect a period of time and a pressure associated with the touch or swipe action. In some embodiments, the multimedia component 808 includes a front camera and/or a rear camera. The front camera and/or the rear camera may receive external multimedia data when the electronic device 800 is in an operation mode, such as a photographing mode or a video mode. Each of the front camera and the rear camera may be a fixed optical lens system or have focusing and optical zooming capabilities.

The audio component 810 is configured to output and/or input an audio signal. For example, the audio component 810 includes a microphone (MIC), and the MIC is configured to receive an external audio signal when the electronic device 800 is in an operation mode, such as a call mode, a recording mode, and a voice recognition mode. The received audio signal may further be stored in the memory 804 or sent through the communication component 816. In some embodiments, the audio component 810 further includes a speaker configured to output the audio signal.

The I/O interface 812 provides an interface between the processing component 802 and peripheral interface modules, such as a keyboard, a click wheel, buttons, and the like. The buttons may include, but are not limited to: a home button, a volume button, a starting button, and a locking button.

The sensor component 814 includes one or more sensors configured to provide status assessments in various aspects for the electronic device 800. For instance, the sensor component 814 may detect an on/off status of the electronic device 800 and relative positioning of components, such as a display and small keyboard of the electronic device 800, and the sensor component 814 may further detect a change in a position of the electronic device 800 or a component of the electronic device 800, presence or absence of contact between the user and the electronic device 800, orientation or acceleration/deceleration of the electronic device 800, and a change in temperature of the electronic device 800. The sensor component 814 may include a proximity sensor configured to detect presence of an object nearby without any physical contact. The sensor component 814 may also include a light sensor, such as a complementary metal oxide semiconductor (CMOS) or charge coupled device (CCD) image sensor, configured for use in an imaging application (APP). In some embodiments, the sensor component 814 may also include an acceleration sensor, a gyroscope sensor, a magnetic sensor, a pressure sensor, or a temperature sensor.

The communication component 816 is configured to facilitate wired or wireless communication between the electronic device 800 and other devices. The electronic device 800 may access a communication-standard-based wireless network, such as a wireless fidelity (WiFi) network, a 2nd-generation (2G) or 3rd-generation (3G) network, or a combination thereof. In an exemplary embodiment, the communication component 816 receives a broadcast signal or broadcast associated information from an external broadcast management system through a broadcast channel In an exemplary embodiment, the communication component 816 further includes a near field communication (NFC) module to facilitate short-range communications. For example, the NFC module may be implemented based on a radio frequency identification (RFID) technology, an infrared data association (IrDA) technology, an ultra-wide band (UWB) technology, a Bluetooth (BT) technology, and other technologies.

In an exemplary embodiment, the electronic device 800 may be implemented by one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, and is configured to execute a screen recording method for a multi-screen electronic device in the abovementioned embodiments.

In an exemplary embodiment, there is also provided a non-transitory computer-readable storage medium including instructions, such as included in the memory 804, executable by the processor 820 of the electronic device 800, for performing any image processing method in the abovementioned embodiments. For example, the non-transitory computer-readable storage medium may be a ROM, a random access memory (RAM), a compact disc read-only memory (CD-ROM), a magnetic tape, a floppy disc, an optical data storage device, and the like.

An embodiment of the present disclosure also provides a non-transitory computer-readable storage medium, instructions in the non-transitory computer-readable storage medium are executed by a processor of an electronic device to cause the electronic device to execute a control method. The control method includes: a dirty region of a display region is determined, and a percentage of the dirty region in the display region is calculated; first image data of the dirty region in an image frame to be updated for displaying and second image data of the dirty region in a presently displayed image frame are acquired, and similarity detection is performed on the first image data and the second image data to generate a similarity detection result; and whether to update the image frame to be updated for displaying to the display region is determined according to the similarity detection result and the percentage of the dirty region in the display region, and if NO, an updating request for the image frame to be updated for displaying is shielded.

An embodiment of the present disclosure also provides a non-transitory computer-readable storage medium, instructions in the non-transitory computer-readable storage medium are executed by a processor of an electronic device to cause the electronic device to execute a control method. The control method includes: a dirty region of a display region is determined; first image data of the dirty region in an image frame to be updated for displaying and second image data of the dirty region in a presently displayed image frame are acquired, and similarity detection is performed on the first image data and the second image data to generate a similarity detection result; and whether to update the image frame to be updated for displaying to the display region is determined according to the similarity detection result, and if NO, an updating request for the image frame to be updated for displaying is shielded.

Other implementation solutions of the present disclosure will be apparent to those skilled in the art from consideration of the specification and practice of the present disclosure. This present disclosure is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

What is claimed is:

1. An image processing method, comprising:

determining a dirty region of a presently displayed image frame, and calculating a percentage of the dirty region in the presently displayed image frame, wherein the dirty region is a region to be redrawn and refreshed in an image frame to be updated for displaying during a process of updating an image on a screen;

acquiring first image data of the dirty region in the image frame to be updated for displaying and second image data of the dirty region in the presently displayed image frame, and performing similarity detection on the first image data and the second image data to generate a similarity detection result; and determining whether to update the image frame to be updated for displaying on the screen according to the similarity detection result and the percentage of the dirty region in the presently displayed image frame, and when NO, shielding an updating request for the image frame to be updated for displaying;

wherein performing the similarity detection on the first image data and the second image data to generate the similarity detection result comprises:

determining color intensity differences between adjacent pixels in the first image data, assigning binary values to the color intensity differences, the assigned binary values of continuous color intensity differences forming a first binary character string, and determining a first hash value of the first binary character string;

determining color intensity differences between adjacent pixels in the second image data, assigning binary values to the color intensity differences, the assigned binary values of continuous color intensity differences forming a second binary character string, and determining a second hash value of the second binary character string; and calculating a Hamming distance between the first hash value and the second hash value, and determining the calculated Hamming distance as a similarity value of the first image data and the second image data to obtain the similarity detection result.

2. The method of claim 1, wherein determining the first hash value of the first binary character string comprises:

performing high-base conversion on the first binary character string to form converted first high-base characters, and sequencing the first high-base characters to form a character string to form a first difference hash value; and performing high-base conversion on the second binary character string to form converted second high-base characters, and sequencing the second high-base characters to form a character string to form a second difference hash value.

3. The method of claim 1, before the color intensity differences between the adjacent pixels in the first image data and the second image data are determined, further comprising:

performing compression to change resolutions of the first image data and the second image data to a set resolution; and converting color red green blue (RGB) values of the first image data and the second image data with the set resolution to gray values for gray image displaying.

4. The method of claim 1, further comprising:

setting a first weight value for the percentage of the dirty region in the presently displayed image frame, and setting a second weight value for the similarity value;

wherein determining whether to update the image frame to be updated for displaying on the screen comprises:

calculating a first product value of the first weight value and the percentage of the dirty region in the presently displayed image frame, and calculating a second product value of the second weight value and the similarity value;

calculating a sum value of the first product value and the second product value; and comparing the sum value with a set threshold value, in response to the sum value being greater than or equal to the set threshold value, determining to update the image frame to be updated for displaying on the screen, and, in response to the sum value being less than the set threshold value, determining not to update the image frame to be updated for displaying on the screen.

5. The method of claim 1, wherein shielding the updating request for the image frame to be updated for displaying comprises:

intercepting, in response to a dynamic adjustment vertical sync (Vsync) signal of the presently displayed image frame being received, the Vsync signal to cause a SurfaceFlinger not to compose a content of the image frame to be updated for displaying.

6. An image processing method, comprising:

determining a dirty region of a presently displayed image frame, wherein the dirty region is a region to be redrawn and refreshed in an image frame to be updated for displaying during a process of updating an image on a screen;

acquiring first image data of the dirty region in the image frame to be updated for displaying and second image data of the dirty region in the presently displayed image frame, and performing similarity detection on the first image data and the second image data to generate a similarity detection result; and determining whether to update the image frame to be updated for displaying on the screen according to the similarity detection result, and when NO, shielding an updating request for the image frame to be updated for displaying;

wherein performing the similarity detection on the first image data and the second image data to generate the similarity detection result comprises:

determining color intensity differences between adjacent pixels in the first image data, assigning binary values to the color intensity differences, the assigned binary values of continuous color intensity differences forming a first binary character string, and determining a first hash value of the first binary character string;

determining color intensity differences between adjacent pixels in the second image data, assigning binary values to the color intensity differences, the assigned binary values of continuous color intensity differences forming a second binary character string, and determining a second hash value of the second binary character string; and calculating a Hamming distance between the first hash value and the second hash value, and determining the calculated Hamming distance as a similarity value of the first image data and the second image data to obtain the similarity detection result.

7. The method of claim 6, wherein determining the first hash value of the first binary character string comprises:

performing high-base conversion on the first binary character string to form converted first high-base characters, and sequencing the first high-base characters to form a character string to form a first difference hash value; and performing high-base conversion on the second binary character string to form converted second high-base characters, and sequencing the second high-base characters to form a character string to form a second difference hash value.

8. The method of claim 6, before the color intensity differences between the adjacent pixels in the first image data and the second image data are determined, further comprising:

performing compression to change resolutions of the first image data and the second image data to a set resolution; and converting color red green blue (RGB) values of the first image data and the second image data with the set resolution to gray values for gray image displaying.

9. The method of claim 6, further comprising:

comparing the similarity value with a set threshold value, in response to the similarity value being greater than or equal to the set threshold value, determining to update the image frame to be updated for displaying on the screen, and, in response to the similarity value being less than the set threshold value, determining not to update the image frame to be updated for displaying on the screen.

10. An image processing device, comprising:

a processor; and a memory for storing instructions executable by the processor;

wherein the processor is configured to:

determine a dirty region of a presently displayed image frame, wherein the dirty region is a region to be redrawn and refreshed in an image frame to be updated for displaying during a process of updating an image on a screen;

calculate a percentage of the dirty region in the presently displayed image frame;

acquire first image data of the dirty region in the image frame to be updated for displaying and second image data of the dirty region in the presently displayed image frame;

perform similarity detection on the first image data and the second image data to generate a similarity detection result; and determine whether to update the image frame to be updated for displaying to the on the screen according to the similarity detection result and the percentage of the dirty region in the presently displayed image frame, and when NO, shield an updating request for the image frame to be updated for displaying;

wherein the processor is further configured to:

determine color intensity differences between adjacent pixels in the first image data and color intensity differences between adjacent pixels in the second image data;

assign binary values to the color intensity differences of the first image data, the assigned binary values of continuous color intensity differences forming a first binary character string, and assign binary values to the color intensity differences of the second image data, the assigned binary values of continuous color intensity differences forming a second binary character string;

determine a first hash value of the first binary character string and a second hash value of the second binary character string;

calculate a Hamming distance between the first hash value and the second hash value; and determine the calculated Hamming distance as a similarity value of the first image data and the second image data to obtain the similarity detection result.

11. The device of claim 10, wherein the processor is further configured to:

perform high-base conversion on the first binary character string to form converted first high-base characters and sequence the first high-base characters to form a character string to form a first difference hash value; and perform high-base conversion on the second binary character string to form converted second high-base characters and sequence the second high-base characters to form a character string to form a second difference hash value.

12. The device of claim 10, wherein the processor is further configured to:

perform compression to change resolutions of the first image data and the second image data to a set resolution; and convert color red green blue (RGB) values of the first image data and the second image data with the set resolution to gray values for gray image displaying.

13. The device of claim 10, wherein the processor is further configured to:

set a first weight value for the percentage of the dirty region in the presently displayed image frame and set a second weight value for the similarity value;

calculate a first product value of the first weight value and the percentage of the dirty region in the presently displayed image frame and calculate a second product value of the second weight value and the similarity value;

calculate a sum value of the first product value and the second product value;

compare the sum value with a set threshold value; and determine, in response to the sum value being greater than or equal to the set threshold value, to update the image frame to be updated for displaying on the screen, and, in response to the sum value being less than the set threshold value, determine not to update the image frame to be updated for displaying on the screen.

14. The device of claim 10, wherein the processor is further configured to:

receive a dynamic adjustment vertical sync (Vsync) signal of the presently displayed image frame; and intercept the Vsync signal to cause a SurfaceFlinger not to compose a content of the image frame to be updated for displaying.

* * * * *